US012104388B2

(12) United States Patent
Eisermann et al.

(10) Patent No.: US 12,104,388 B2
(45) Date of Patent: Oct. 1, 2024

(54) FLOOR PANEL WITH SEPARATE CLIP FOR A VERTICAL LOCK

(71) Applicant: Windmöller GmbH, Augustdorf (DE)

(72) Inventors: Ralf Eisermann, Cochem (DE); Marcus Hanheide, Lemgo (DE)

(73) Assignee: Windmöller GmbH, Augustdorf (DE)

( * ) Notice: Subject to any disclaimer, the term of this patent is extended or adjusted under 35 U.S.C. 154(b) by 197 days.

(21) Appl. No.: 17/784,330

(22) PCT Filed: Nov. 17, 2020

(86) PCT No.: PCT/EP2020/082421

§ 371 (c)(1),
(2) Date: Jun. 10, 2022

(87) PCT Pub. No.: WO2021/121835

PCT Pub. Date: Jun. 24, 2021

(65) Prior Publication Data

US 2023/0042342 A1 Feb. 9, 2023

(30) Foreign Application Priority Data

Dec. 18, 2019 (DE) ..... 102019134858.7

(51) Int. Cl.
*E04F 15/02* (2006.01)

(52) U.S. Cl.
CPC ..... *E04F 15/02038* (2013.01); *E04F 2201/0146* (2013.01); *E04F 2201/0153* (2013.01);
(Continued)

(58) Field of Classification Search
CPC ..... E04F 15/02038; E04F 2201/0146; E04F 2201/0153; E04F 2201/0535;
(Continued)

(56) References Cited

U.S. PATENT DOCUMENTS 8,615,952 B2 * 12/2013 Engstrom ..... E04F 15/02038 52/489.2
8,621,814 B2 * 1/2014 Cappelle ..... E04F 15/10 52/592.1
(Continued)

FOREIGN PATENT DOCUMENTS

DE 202007000310 U1 4/2007
DE 202009004530 U1 6/2009
(Continued)

*Primary Examiner* — Brian E Glessner
*Assistant Examiner* — Adam G Barlow
(74) *Attorney, Agent, or Firm* — Richard M. Goldberg

(57) ABSTRACT

A set of floor panels includes a first floor panel having a first holding profile at a lateral edge, a second floor panel having a second holding profile at a lateral edge joinable to the first holding profile by a substantially vertically oriented downward movement of the second floor panel, and a separate L-shaped clip including a horizontal leg, a vertical leg and a detent tab adjoining an upper end of the vertical leg, the clip inserted into a clip groove of the first holding profile, the detent tab attaining a locking position for vertically locking the holding profiles during or after the downward movement of the second floor panel, such that when the clip is inserted into the clip groove, the horizontal leg generates a tensioning force by which the upper end of the vertical leg is pushed against an upper delimiting wall of the clip groove.

9 Claims, 2 Drawing Sheets

(52) U.S. Cl.
CPC ..... *E04F 2201/0535* (2013.01); *E04F 2201/0552* (2013.01)

(58) Field of Classification Search
CPC ..... E04F 2201/0552; E04F 2201/0594; E04F 2201/0138; E04F 2201/0176; E04F 2201/0115; E04F 2201/0523; E04F 2201/0558; E04B 1/6116
USPC ..... 52/582.1, 582.2, 588.1, 581, 590.2
See application file for complete search history.

(56) References Cited

U.S. PATENT DOCUMENTS 8,720,148 B2 * 5/2014 Engstrom ..... E04F 15/02005 52/391
8,938,929 B2 * 1/2015 Engstrom ..... E04F 15/02022 52/592.1
8,978,334 B2 * 3/2015 Engstrom ..... E04F 15/02 52/391
9,290,948 B2 * 3/2016 Cappelle ..... E04F 15/02038
10,422,143 B2 * 9/2019 Bevernage ..... E04F 15/02038
11,002,021 B2 * 5/2021 Cappelle ..... E04F 15/02
2003/0180091 A1 * 9/2003 Stridsman ..... E04F 15/02 404/41
2007/0006543 A1 * 1/2007 Engstrom ..... E04F 15/02 52/592.1
2008/0236088 A1 * 10/2008 Hannig ..... F16B 5/0056 52/592.1
2009/0019806 A1 * 1/2009 Muehlebach ..... E04F 15/02 52/588.1
2009/0217615 A1 * 9/2009 Engstrom ..... E04F 21/22 52/586.1
2010/0281803 A1 * 11/2010 Cappelle ..... E04F 15/02038 52/309.1
2011/0271631 A1 * 11/2011 Engstrom ..... E04F 15/02005 52/582.2
2011/0271632 A1 * 11/2011 Cappelle ..... F16B 5/0056 52/582.2
2012/0055112 A1 * 3/2012 Engstrom ..... E04F 15/02144 52/582.2
2014/0130437 A1 * 5/2014 Cappelle ..... E04F 15/02038 52/582.2
2015/0176289 A1 * 6/2015 Hannig ..... E04F 15/02038 52/582.2
2015/0337540 A1 * 11/2015 Cappelle ..... E04F 15/105 52/309.1
2018/0298618 A1 * 10/2018 Bevernage ..... E04F 15/02038
2022/0136257 A1 * 5/2022 Cappelle ..... E04F 15/02011 52/588.1

FOREIGN PATENT DOCUMENTS

DE 202017101029 U1 * 5/2017
EP 1159497 B1 12/2001
WO WO-2014191861 A1 * 12/2014 ..... E04F 15/02038

* cited by examiner

FLOOR PANEL WITH SEPARATE CLIP FOR A VERTICAL LOCK

BACKGROUND OF THE INVENTION

The invention relates to a set of floor panels comprising a first floor panel, which has a first holding profile at a lateral edge, and comprising a second floor panel, which has a second holding profile at a lateral edge, the second holding profile being joinable to the first holding profile by means of a substantially vertically oriented downward movement of the second floor panel.

Floor panels comprising holding profiles are known from EP 1 159 497 B1, which can be joined to one another by a vertical downward movement. The first floor panel is placed into the installation plane, or is already located in the installation plane of the flooring to be created by the installation of the floor panels. The second floor panel is then positioned at a certain vertical distance with respect to the installation plane such that the second holding profile thereof is arranged above the first holding profile of the first floor panel that was previously installed. As a result of the vertical downward movement of the second floor panel, the two holding profiles can be joined to one another. To ensure that, after the downward movement has taken place, the holding profiles that are joined to one another are locked in the vertical direction, a separate clip is provided, which is inserted into a clip groove of the first holding profile. The clip has a substantially L-shaped design and includes a horizontal leg and a vertical leg. A detent tab adjoins an upper end of the vertical leg, which is pushed downward and in the direction of the vertical leg during the downward movement of the second floor profile. After the downward movement of the second floor panel has taken place, the detent tab snaps back again and attains a locking position in which the detent tab is located in a locking groove of the second holding profile. In this locking position of the detent tab, it is not possible to raise the second holding profile again in relation to the first holding profile. The two holding profiles are thus locked in the vertical direction. The separate clip of EP 1 159 497 B1 moreover includes a further extension, which adjoins at an end of the horizontal leg which faces away from the vertical leg. This further extension ensures that the clip is held in the clip groove and does not fall out.

Further holding profiles, which can be joined by a downward movement, for joining floor panels are known from US 2007/0006543 A1. Again, a separate clip comprising a detent tab, a vertical leg and a horizontal leg ensures vertical locking. During the downward movement, the holding profile of the downwardly guided floor panel pushes against the horizontal leg, whereby the vertical leg and the detent body are pushed into the locking position. The entire clip is thus moved when the holding profiles are joined. As a result, the clip must be inserted with appropriate play into the clip groove. The clip is thus seated loosely in the clip groove and can easily fall out.

DE 20 2007 000 310 U1 likewise discloses floor panels comprising holding profiles and a separate clip for vertical locking. In addition to the movable detent tab, the clip includes an insertion section, which is seated in a separate recess of the clip groove. To prevent the clip from falling out of the clip groove, the insertion section has to be pressed into the recess or be glued therein, which involves additional assembly complexity.

SUMMARY OF THE INVENTION

It is therefore the object of the invention to provide a set of floor panels comprising holding profiles and a separate clip for vertical locking, which can be easily produced and joined.

The object of the invention is achieved by the feature combination according to the claims. Exemplary embodiments of the invention can be derived from the dependent claims.

According to the invention, it is provided that, when the clip is inserted into the clip groove, the horizontal leg generates a tensioning force, by which the upper end of the vertical leg is pushed against an upper delimiting wall of the clip groove. The clip is clamped in the clip groove in the vertical direction, whereby the risk of falling out of the clip groove during the installation or other handling of the floor panels is essentially precluded. As a result of the upper end of the vertical leg bearing against the upper delimiting wall of the clip groove, the position of the clip within the clip groove is precisely predefined, so that the clip, with the movable detent tab, can reliably attain the locking position during the downward movement of the second floor panel.

The term "vertical leg" does not preclude the vertical leg from being inclined with respect to the vertical, that is, with respect to the normal of the installation plane. The angle of inclination with respect to the vertical can be smaller than 15 or 10°. The horizontal leg can have an angle of inclination different from 0 with respect to the horizontal or with respect to the installation plane. In one exemplary embodiment, the angle of inclination of the horizontal leg with respect to the horizontal is less than 20 or 15°.

In one exemplary embodiment, the upper delimiting wall of the clip groove essentially extends in the horizontal direction. An angle of inclination of the upper delimiting wall with respect to the horizontal or with respect to the installation plane is preferably smaller than 15° or even 10°.

In one exemplary embodiment, a claw element is provided at the upper end of the vertical leg, which holds on to the upper delimiting wall of the clip groove. The claw element can act as a barb in the process, which digs into and hooks onto the material in which the clip groove is integrally formed. In particular, the claw element or the barb is to prevent the clip from sliding with the upper end of the vertical leg laterally out of the clip groove after the clip has been inserted into the clip groove.

The horizontal leg of the clip can be supported with an outer end at a lower delimiting wall of the clip groove. When the clip is inserted, the horizontal leg is subjected to bending stress and is consequently deformed similarly to a cantilever or bending beam that is subject to loading. Assuming a rectilinear horizontal leg in the unloaded state, the horizontal leg, when inserted into the clip groove, that is, in the loaded state, is bent or curved.

The lower delimiting wall is spaced apart from the upper delimiting wall and preferably has a similar inclination with respect to the horizontal or with respect to the installation plane as the upper delimiting wall. In one exemplary embodiment, the lower delimiting wall and the upper delimiting wall are designed parallel to one another.

A clearance can arise between an underside of the horizontal leg and the lower delimiting wall of the clip groove, which, as viewed in the horizontal direction, extends continuously from the outer end of the horizontal leg to the vertical leg. A continuous clearance exists when the horizontal leg bears only with the outer end thereof against the lower delimiting wall, and otherwise has no contact with the lower delimiting wall of the clip. Proceeding from the outer end of the horizontal leg, a height of the clearance can increase continuously and take on the maximum thereof at the vertical leg or in the vicinity thereof.

In one exemplary embodiment, the clip groove can comprise an outer delimiting wall against which the outer end of the horizontal leg is supported in the horizontal direction. In this way, fixing or clamping of the clip in the clip groove is not only possible in the vertical direction (between the lower delimiting wall and upper delimiting wall), but also in the horizontal direction.

A ratio of a length of the horizontal leg to a length of the vertical leg can take on values between 0.8 and 1.2. In one exemplary embodiment, the vertical leg and the horizontal leg have approximately the same length (in this case, this means that the above ratio has a value of 1 or deviates only slightly therefrom (values between 0.9 and 1.1)).

The first floor panel can have a thickness of 4 to 12 mm, wherein the length of the vertical leg can be 30% to 60% of the thickness. If, for example, the thickness of the floor panel is 8 mm, the vertical leg can be 2.4 to 4.8 mm long.

The first floor panel and the second floor panel are preferably structurally identical floor panels, so that the comments above or the comments below with regard to the first floor panel should also apply, mutatis mutandis, to the second floor panel. The first floor panel can be configured at a first lateral edge with the first holding profile and at a second lateral edge, located opposite the first lateral edge, with the second holding profile.

An angle between the horizontal leg and the vertical leg can be greater than 90° when the clip is inserted into the clip groove. In the unloaded state, the angle between the horizontal leg and the vertical leg is greater than the corresponding angle when the clip is inserted into the clip groove, since the horizontal leg is deformed in the direction of the vertical leg during insertion into the clip groove. In the non-deformed state of the clip, the angle between the horizontal leg and the vertical leg can take on values between 100 and 120°.

The second holding profile can comprise a downwardly oriented hook element, which forms an approximately vertically extending locking surface for horizontally locking the floor panels. An angle of inclination of the locking surface with respect to the vertical is preferably smaller than 10°.

The first holding profile can include a lower lip and an upwardly directed projection, which forms a likewise approximately vertically extending locking surface to bear directly against the locking surface of the hook element. The locking surface of the projection and the locking surface of the hook element preferably rest on top of one another across the entire surface. In the joined state, the first holding profile and the second holding profile are thus locked in the vertical direction (perpendicular to the installation plane) and in the horizontal direction (lying in the installation plane and transversely to the longitudinal extension of the first and second holding profiles).

A locking groove comprising a bearing surface for the detent tab can be integrally formed into the hook element of the second holding profile. In the locking position, the detent tab bears against the bearing surface of the locking groove.

The bearing surface can have an angle with respect to the installation plane which takes on values between 30 and 60°. The bearing surface of the locking groove is thus not a surface that is vertically or substantially vertically oriented, but a surface that is clearly inclined with respect to the vertical. Preferred values for this angle range between 40 and 50°.

The first floor panel can include a third holding profile at a further lateral edge, and the second floor panel can include a fourth holding profile at a further lateral edge, wherein the third holding profile can be joined to the fourth holding profile so as to form a vertical lock and a horizontal lock of these holding profiles. The third holding profile and the fourth holding profile can be configured such that the second floor panel can be joined simultaneously to the first floor panel and a third identical floor panel by a single pivoting movement. The method of installation by way of such a pivoting movement is also referred to as the fold-down installation technique. As an alternative, it is possible to join the floor panels at all lateral edges by way of a vertically oriented downward movement.

The first floor panel preferably has a rectangular basic shape, wherein the first holding profile and the second holding profile can be arranged at opposing short lateral edges, while the third holding profile and the fourth holding profile can be arranged at opposing long lateral edges. A length of the long lateral edges can be 50 cm to 2.40 m. A length of the short lateral edges can take on values between 10 and 40 cm.

The first holding profile and the second holding profile can be integrally formed into a core layer of the first floor panel. The core layer can be made of wood-based materials, such as MDF or HDF, or can also be made of plastic such as PU or PVC. The plastic can be filled with mineral fillers such as chalk. A decorative layer can be provided above the core layer, which can encompass a decorative paper or a decorative film. The decorative layer may also only be a digital print that is applied onto the core layer.

The decorative layer can encompass one or more wear layers that protect the decorative film, the decorative paper or the decorative print. Beneath the core layer, a stabilizing layer and/or a sound insulation layer can be provided. It is also conceivable for a soft or elastic layer for (further) sound insulation to be provided between the decorative layer and the core layer.

The clip can be made of plastic, which can be produced by way of an extrusion method. Acrylonitrile butadiene styrene (ABS) copolymers shall be mentioned as a preferred plastic.

BRIEF DESCRIPTION OF THE DRAWINGS

The invention will be described in more detail based on an exemplary embodiment shown in the drawings. In the drawings.

DETAILED DESCRIPTION

Figure 1:
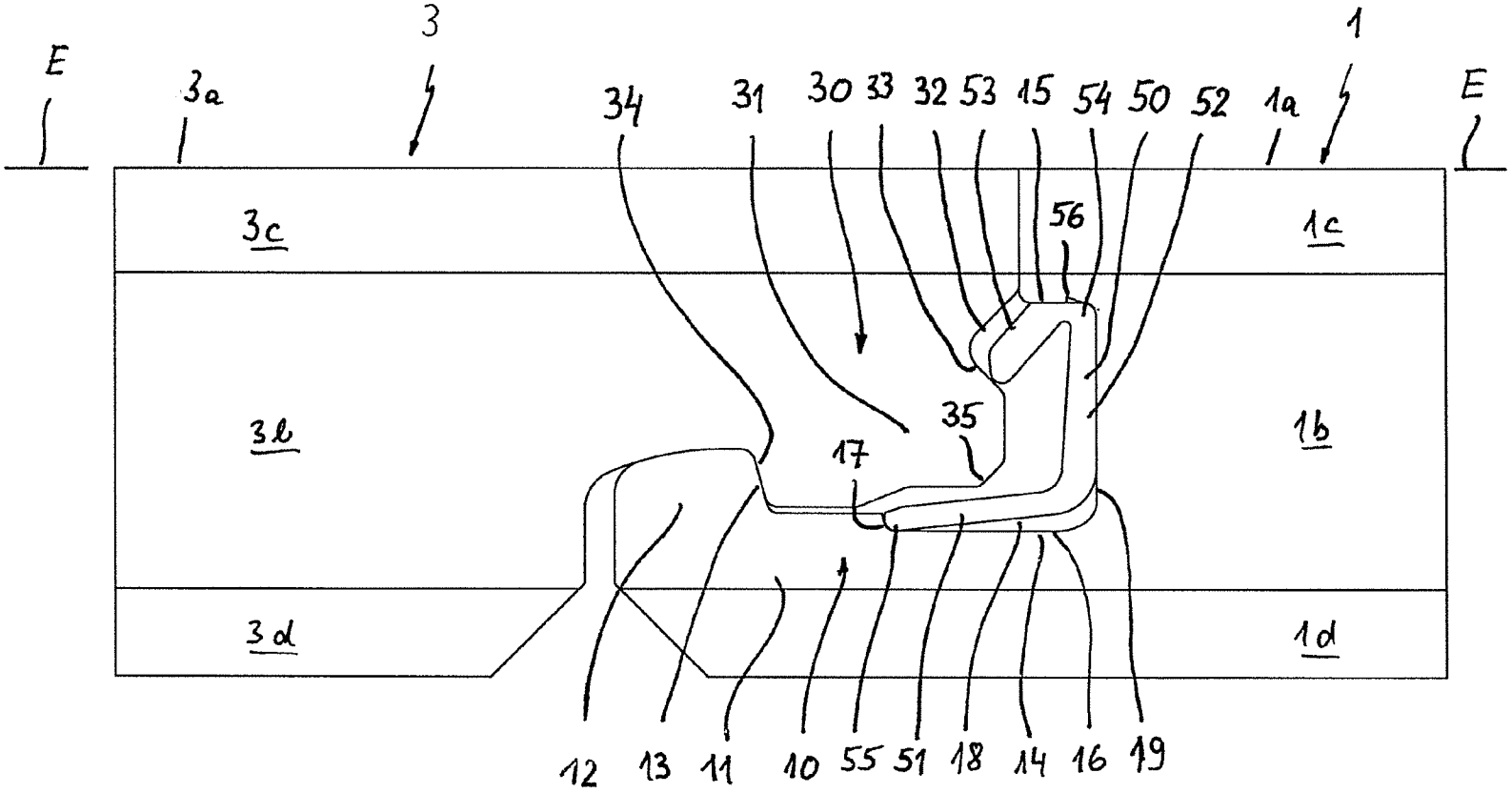
FIG. 1 shows a first holding profile and a second holding profile when joined by a separate clip.

FIG. 1 shows a section of a first floor panel, which is denoted by reference numeral 1. At a lateral edge, the first floor panel 1 has a first holding profile 10. The first holding profile 10 is joined to a second holding profile 30 of a second floor panel 3, of which likewise only a section is shown.

The first holding profile 10 includes a lower lip 11 and an upwardly directed projection 12 adjoining the same, which forms an approximately vertically extending locking surface 13. A separate clip or a separate locking element 50, which includes a horizontal leg 51, a vertical leg 52 and a detent tab 53, is inserted into a clip groove 14. The detent tab 53 adjoins an upper end 54 of the vertical leg 52. The upper end 54 of the vertical leg 52 bears against an upper delimiting wall 15 of the clip groove 14. The delimiting wall 15 extends horizontally here, that is, parallel to the installation plane E. An upper outer surface 1*a* of the first floor panel 1 and an upper outer surface 3*a* of the second floor element 3 are located in the installation plane E.

The clip groove 14 includes a lower delimiting wall 16 against which the horizontal leg 51 is supported. The horizontal leg 51 is supported with an outer end 55 against the lower delimiting wall 16. The vertical distance between the upper delimiting wall 15 and the lower delimiting wall 16 of the clip groove 14 is dimensioned such that the horizontal leg 51 is deformed when the clip 50 is being inserted into the clip groove. Due to the elasticity of the material of which the clip 50 is made, a tensioning force is thus generated in the horizontal leg 51, by way of which the vertical leg 52 and the detent tab 53 are pushed upward against the upper delimiting wall 15. The deformed horizontal leg 51 thus acts in the manner of a compression spring that pushes from beneath against the vertical leg 52. Due to the elastically deformed horizontal leg 51, the position of the vertical leg 52 and the position of the detent tab 53 within the groove 14, and thus the position of the detent tab 53 relative to the first holding element 10, are precisely defined. Regardless of the fact that, due to manufacturing tolerances, the distance between the upper delimiting wall 15 and the lower delimiting wall 16 may vary slightly, and regardless of the fact that the dimensions of the clip 50 may also vary slightly for manufacturing reasons, the upper end 54 and the detent tab 53 always bear with a certain pretension against the upper delimitation 15 of the clip groove 14.

In the horizontal direction, the outer end 55 of the horizontal leg 51 bears against an outer delimiting wall 17 of the clip groove 14. The outer delimiting wall 17 absorbs horizontally acting forces, which act by the inserted clip 50 onto the first holding profile 10. A claw element 56 is provided at the upper end 54 of the vertical leg 52, which prevents the upper end 54 of the vertical leg 52 and the detent tab 53 from sliding laterally out of the clip groove 14.

A clearance 18 arises between an underside of the horizontal leg 51 and the lower delimiting wall 16 of the clip groove, which extends continuously from the outer end 55 of the horizontal leg 51 to the vertical leg 52. Starting at 0 in the region of the outer end 55, a height of this clearance 18 increases continuously in the direction of the vertical leg 52. The clearance 18 illustrates that the horizontal leg 51 bears only with the outer end 55 thereof against the lower delimiting wall 16.

The clip groove 14 furthermore includes an inner delimiting wall 19 against which the vertical leg 52 bears laterally. The horizontal leg 51 thus acts also as a compression spring in the horizontal direction, by way of which the vertical leg 52 is pushed laterally against the inner delimiting wall 19. The horizontal leg 51, or more precisely, the deformation thereof when the clip 50 is inserted into the clip groove 14, ensures that the position of the vertical leg 52 with the detent tab 53 is exactly defined both in the vertical direction and in the horizontal direction, based on the outer delimiting wall 17 and the inner delimiting wall 19 of the clip groove 14.

The second holding profile 30 of the second floor panel 3 encompasses a downwardly oriented hook element 31, into which a locking groove 32 comprising a bearing surface 33 for the detent lug 53 is integrally formed. An angle of inclination of this bearing surface 33 with respect to the installation plane E here is in a range of 42 to 48°.

The second holding profile 30 moreover forms an approximately vertically extending locking surface 34, which bears against the locking surface 13 of the first holding profile 10. As a result of the cooperation of the locking surfaces 34 and 13, the holding profiles 10, 30, and thus the floor panels 1, 3, are locked with one another in the horizontal direction. The cooperation between the bearing surface 33 of the second holding profile 30 and the detent tab 53 ensures vertical locking of the holding profiles 10, 30 or floor panels 1, 3.

It shall be pointed out that the horizontal locking of the holding profiles 10, 30 by virtue of the locking surfaces 13, 34 is decoupled from the clip 50 and the positioning thereof in the clip groove 14. The outer delimiting wall 17 is thus spaced apart from the locking surface 13 in the horizontal direction. The locking surface 34 bears directly against the locking surface 13, without parts of the clip 50 being arranged between these locking surfaces 13, 34.

To join the holding profiles 10, 30, initially the first floor panel 1 is installed, so as to be located with the upper outer surface 1*a* thereof in the installation plane E. The second floor panel 3 is then positioned such that the second holding profile 30 is arranged precisely above the first holding profile 10. The second floor panel 3 comprising the second holding profile 30, is then moved vertically downward, wherein a lower outer corner 35 of the second holding profile 30, which includes a chamfer in the embodiment shown here, pushes against the detent tab 53. The detent tab 53 is thus pivoted in the direction of the vertical leg 52, so that the hook element 31 can be guided past the detent tab 53 further downward. At the end of the downward movement of the second floor panel 3, the detent tab 53 snaps into the locking groove 32 and ends up bearing against the locking surface 33. The downwardly oriented vertical movement of the second floor panel 3*a* can be a linear downward movement, or also a pivoting movement, during which the holding profiles 10, 30 are moved toward one another in a scissor-like manner, similarly to the two blades of scissors. The latter manner of joining the holding profiles 10, 30 is provided with the fold-down installation technique, which is known from WO 01/75247 A1, for example.

The first holding profile 10 is integrally formed into a core layer 1*b* of the first floor panel, for example by way of milling. The above-described claw element 56 digs into the material of the core layer (for example MDF, HDF, plastic such as PU or PVC, WPC, etc.). Above the core layer 1*b*, a decorative layer 1*c* is shown purely schematically, which can, in turn, be composed of different layers, such as decorative film/decorative paper, a top layer or wear layer etc. A back layer 1*d*, which can be made of one layer or multiple layers, is arranged beneath the core layer 1*b*, which is likewise only hinted at. The back layer 1*d* can act as a stabilizing layer for the decorative layer 1*c* and/or as an insulating layer. The second floor panel has the same layer design as the first floor panel (see layers 3*c*, 3*b* and 3*d*).

Figure 2A:
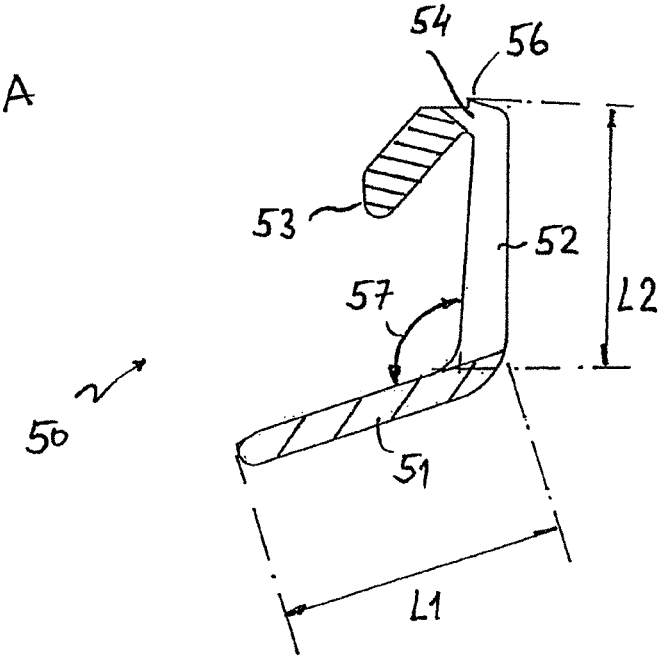
FIG. 2 shows the clip of FIG. 1 in an unloaded state (FIGS. 2A and 2B).
Figure 2B:
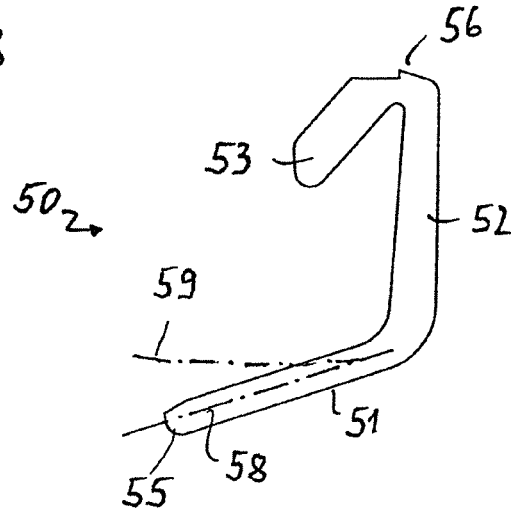

FIGS. 2A and 2B show the clip 50 alone and in a non-deformed state. In combination with FIG. 1, it is apparent that, in the non-deformed state, an angle 57 between the vertical leg 52 and the horizontal leg 51 is greater than in the state in which the clip 50 is clamped into the clip groove 14. FIG. 2B shows the center axis 58 of the non-deformed horizontal leg 51 as a dash-dotted line, and the center axis 59 of the deformed or bent horizontal leg 51 likewise as a dash-dotted line. From this, it is apparent that the horizontal leg 51 behaves similarly to a cantilever, to the outer end of which a force is applied and which accordingly undergoes deformation. When the clip 50 is clamped into the clip groove 14, the horizontal leg 51 is thus no longer rectilinear, as it is in the unloaded state, but it is curved. In this respect, the illustration of the horizontal leg 51 in FIG. 1 as a rectilinearly extending leg shall only be understood to be schematic. Rather, the horizontal leg 51, due to the forces acting thereon, is curved, as is indicated by the curved center line 59 in FIG. 2B.

In FIG. 2A, the detent tab 53 and the horizontal leg 51 are hatched in each case. As was already stated above, when the holding profiles 10, 30 are being joined, the detent tab 53 is first pivoted in the direction of the vertical leg 52, so as to then snap back again to attain the locking position. During this pivoting of the detent tab 53 in the direction of the vertical leg 52, primarily the upper end 54 of the vertical leg 52 is deformed. This elastic deformation of the upper end 54 causes the detent tab 53 to snap back into the locking groove 32. Due to its comparatively large thickness, the detent tab 53 is not or hardly deformed. Rather, it is to be designed so as to fulfill the task of the vertical locking and so as not to deform and buckle when the bearing surface 33 pushes from beneath against the detent tab 53 when the holding profiles 10, 30 are joined.

FIG. 2A also shows the length L1 for the horizontal leg 51 and the length L2 for the vertical leg 52. In one exemplary embodiment, the length L1 is in a range of 3.5 to 3.9 mm, and the length L2 is in a range of 2.9 to 3.3 mm. The ratio L1/L2 is preferably between 1 and 1.1.

LIST OF REFERENCE NUMERALS

1 first panel
1 a upper outer surface
1*b* core layer
1*c* decorative layer
1*d* back layer
3 second floor panel
3*a* upper outer surface
3*b* core layer
3*c* decorative layer
3*d* back layer
10 first holding element
11 lower lip
12 projection
13 locking surface
14 clip groove
15 upper delimiting wall
16 outer delimiting wall
18 clearance
19 inner delimiting wall
30 second holding profile
31 hook element
32 locking groove
33 bearing surface
34 locking surface
35 outer lower tip
50 clip
51 horizontal leg
52 vertical leg
53 detent tab
54 upper end
55 outer end
56 claw element/barb
57 angle
58 rectilinear center line
59 curved center line
E installation plane
L1 length of the horizontal leg 51
L2 length of the vertical leg 53

What is claimed is:

1. A set of floor panels comprising:

a first floor panel which has a first holding profile at a lateral edge thereof, a second floor panel which has a second holding profile at a lateral edge thereof, the second holding profile being joinable to the first holding profile by a substantially vertically oriented downward movement of the second floor panel, and a separate clip which is substantially L-shaped and includes a horizontal leg, a vertical leg and a detent tab adjoining an upper end of the vertical leg, the clip adapted to be inserted into a clip groove of the first holding profile, such that the detent tab attains a locking position for vertically locking the holding profiles during or after the downward movement of the second floor panel, wherein, when the clip is inserted into the clip groove, the horizontal leg generates a tensioning force by which the upper end of the vertical leg is pushed against an upper delimiting wall of the clip groove, wherein the horizontal leg of the clip is supported with an outer end thereof against a lower delimiting wall of the clip groove, wherein a clearance arises between an underside of the horizontal leg and the lower delimiting wall of the clip groove, which extends from the outer end of the horizontal leg to the vertical leg, wherein the clip groove includes an outer delimiting wall against which an outer end of the horizontal leg is supported in the horizontal direction, wherein the second holding profile comprises a downwardly oriented hook element, wherein the hook element comprises an approximately vertically extending locking surface for horizontally locking the floor panels, and wherein the first holding profile includes a lower lip and an upwardly directed projection comprising an approximately vertically extending locking surface to bear directly against the locking surface of the hook element.

2. The set of floor panels according to claim 1, wherein the clip includes a claw element at the upper end of the vertical leg, which holds on to the upper delimiting wall of the clip groove.

3. The set of floor panels according to claim 1, wherein a ratio of a length of the horizontal leg to a length of the vertical leg is between 0.8 and 1.2.

4. The set of floor panels according to claim 1, wherein an angle between the horizontal leg and the vertical leg is greater than 90° when the clip is inserted into the clip groove.

5. The set of floor panels according to claim 1, wherein a locking groove comprising a bearing surface for the detent tab is integrally formed into the hook element.

6. The set of floor panels according to claim 5, wherein the bearing surface has an angle of 40 to 50° with respect to an installation plane of the first and second floor panels.

7. The set of floor panels according to claim 1, wherein the first floor panel includes a third holding profile at a further lateral edge, and the second floor panel includes a fourth holding profile at a further lateral edge, the third holding profile being joinable to the fourth holding profile so as to form a vertical lock and a horizontal lock.

8. The set of floor panels according to claim 7, wherein the third holding profile and the fourth holding profile are configured such that the second floor panel is adapted to be joined simultaneously to the first floor panel and a third floor panel by a pivoting movement.

9. The set of floor panels according to claim 1, wherein the horizontal leg of the clip is supported by the lower delimiting wall at one position only with only an outer end thereof against the lower delimiting wall of the clip groove.

* * * * *